United States Patent [19]

Bonfils

[11] 4,211,382

[45] Jul. 8, 1980

[54] PICTURE FRAME RETAINER

[76] Inventor: Robert J. Bonfils, 6750 Alamo Way, La Mesa, Calif. 92041

[21] Appl. No.: 843,975

[22] Filed: Oct. 20, 1977

[51] Int. Cl.[2] ..... A47F 7/14; A47G 1/16

[52] U.S. Cl. ..... 248/467; 248/494; 248/206 A

[58] Field of Search ..... 248/206 A, 494, 467, 248/495, 496; 24/73 MS, 201 B

[56] References Cited

U.S. PATENT DOCUMENTS

| | | | |
|---|---|---|---|
| 2,389,298 | 11/1945 | Ellis | 24/73 MS |
| 2,643,840 | 6/1953 | Lanman | 248/494 |
| 2,742,250 | 4/1956 | Cronberger | 248/206 A |
| 2,879,018 | 3/1959 | Pence | 248/494 |
| 2,959,832 | 11/1960 | Baermann | 24/73 MS |
| 3,228,133 | 1/1966 | Baermann | 248/206 A |
| 3,314,634 | 4/1967 | Carter | 248/206 A |
| 3,350,045 | 10/1967 | Mayers | 248/206 A |
| 3,468,576 | 9/1969 | Beyers et al. | 24/201 B |
| 3,604,673 | 9/1971 | Klein | 248/467 |
| 3,749,301 | 7/1973 | Peckar | 248/206 A |
| 3,792,511 | 2/1974 | Evans | 24/73 MS |

*Primary Examiner*—Lawrence J. Staab
*Attorney, Agent, or Firm*—Brown & Martin

[57] ABSTRACT

A method and apparatus for aligning and maintaining alignment of a picture frame includes one or more pairs of cooperating magnetic members, one of each pair being secured respectively by adhesive or the like to the bottom edge of the picture frame and a cooperating one of the pair secured to the wall behind the picture frame. The members are aligned or secured together and the frame alinged and then the members are secured to the frame and wall in alignment. This arrangement permits the frame to be removed for cleaning and the like and repositioned into alignment without difficulty. The resecuring or fastening apparatus secures the frame and maintains the frame in alignment.

1 Claim, 5 Drawing Figures

PICTURE FRAME RETAINER

BACKGROUND OF THE INVENTION

The present invention relates to fastening devices and pertains particularly to apparatus for securing picture frames or the like into and maintaining it in an aligned position.

Picture frames and the like are typically supported on a wall by means of a nail or hook mounted in the wall and a flexible wire bail extending across the back of the frame. The frame typically swings downward with the lower edge into engagement with the wall. When a frame becomes misaligned, such as from vibrations such as earthquakes and the like and from accidental engagement by other objects, the frame tends to stay misaligned until physically straightened.

Numerous securing devices are on the market for securing picture frame mounts into an aligned position. These devices, however, have numerous drawbacks. One such device, for example, comprises double adhesive tape strips which are secured to the back of the frame and to the wall for securing the frame into position. The problem with this arrangment is that it would be impossible to temporarily dismount the frame and remount in an aligned position. It would be necessary to obtain new securing pads and replace the old ones with the new ones any time the frame is moved.

It is therefore desirable that a method and apparatus be available for semi-permanently securing picture frames and similar wall hangings into an aligned position.

SUMMARY AND OBJECTS OF THE INVENTION

It is therefore the primary object of the present invention to overcome the above problems of the prior art.

Another object of the present invention is to provide new and improved method and apparatus for securing wall hangings, such as picture frames, into a semi-permanent aligned position.

In accordance with the primary aspect of the present invention, the picture frame and other similar wall hangings are maintained in a selected semi-permanent alignment by means of fastening apparatus comprising at least a pair of magnetically attractable members, one of said members mounting on the lower back of the frame or the wall hanging and the other of said members mounted in alignment on the wall behind the wall hanging.

BRIEF DESCRIPTION OF THE DRAWINGS

The above and other objects and advantages of the present invention will become apparent from the following description when read in conjunction with the drawings, wherein.

DETAILED DESCRIPTION OF A PREFERRED EMBODIMENT

Figure 1:
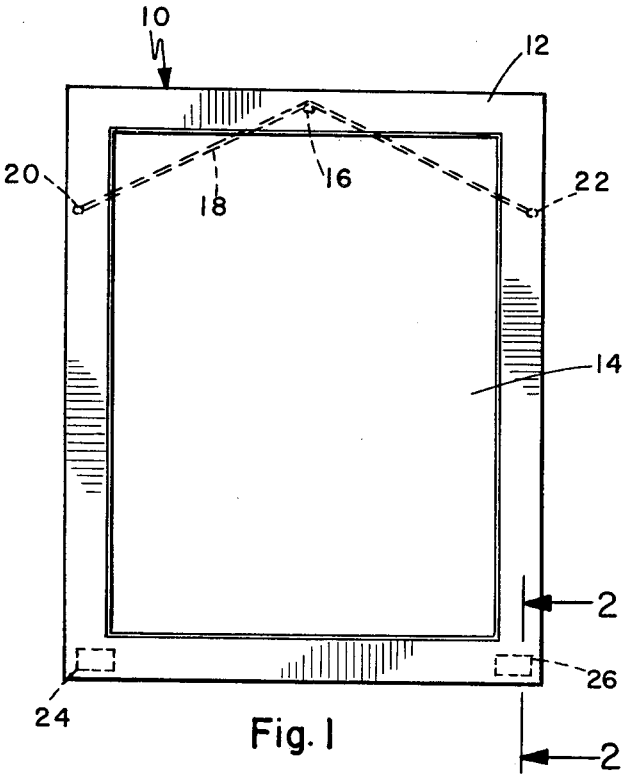
FIG. 1 illustrates a typical picture frame with two magnetic retainers attached.

Turning now to FIG. 1 of the drawing, there is illustrated a picture frame designated generally by the numeral 10, comprising an outer generally rectangular frame 12 mounting a picture 14. The frame is secured or mounted on a wall by means of a nail or the like 16, which is mounted into or on the wall. A flexible member, such as a strand of wire 18, is secured to the frame at both ends by screws, nails or the like 20 and 22. The flexible wire 18 extends over the nail 16 for mounting the frame onto the wall.

It will be appreciated that because of the location of the pivot point 16, the frame assembly will act similar to a pendulum and can swing from side to side. This however is generally prevented by a frictional engagement of the lower portion of the frame engaging the wall.

Figure 2:
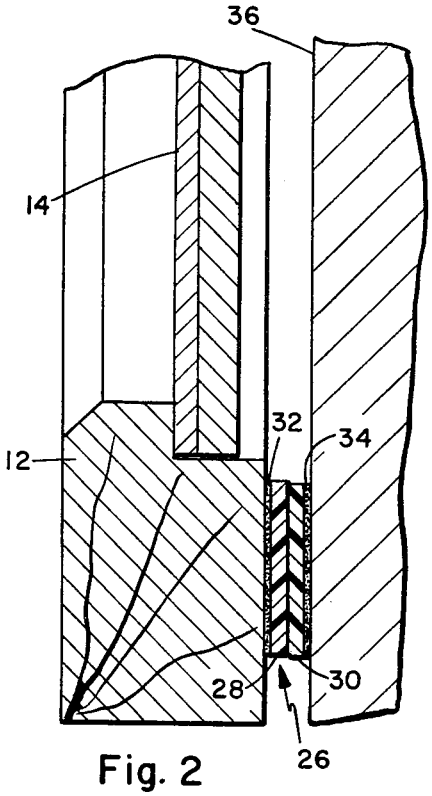
FIG. 2 is an enlarged sectional view taken on line 2—2 of FIG. 1.

In accordance with present invention a pair of retainer assemblies 24 and 26 secure the frame 12 into position on the wall. Turning specifically to FIG. 2, the retainer assemblies each comprise a pair of magnetic members 28 and 30. One of the members 28 is secured to the back of frame 12 by means of an adhesive 32. The other retainer 30 also a magnetic member, is secured such as by an adhesive strip or backing 34 to a wall 36.

Figure 3:
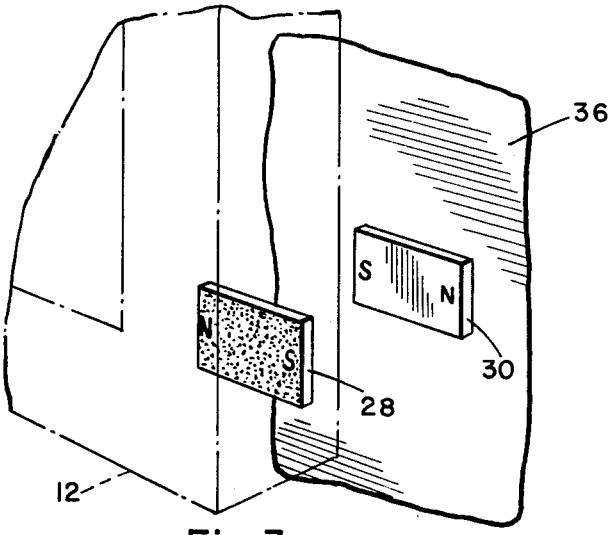
FIG. 3 is a perspective view showing the alignment of the magnetic elements of a retainer.

While the magnetic members may take any suitable form, the preferred form is that of a magnetic plastic tape, such strips being available, for example, from the 3M Company under the trademark Plastiform, permanent magnetic strips, product No. MGO-1017. Such magnetic strips include a pressure sensitive adhesive backing which is covered by a protective strip or sheet. The tape is polarized so as to have north and south poles along opposite edges thereof. Accordingly, strips must be properly oriented such that the attracting poles are opposite one another when the picture frame is aligned, such as shown in FIG. 3. The poles may be oriented either vertically or horizontally. However, they must be oriented to permit relative sliding movement in the horizontal direction to permit minor adjustments to be made in the lateral positioning of the frame. Any number of the retaining assemblies may be utilized as necessary for the particular picture or wall hanging involved. The present invention may be utilized in conjunction with the alignment and retaining of other wall hangings other than picture frames.

In the preferred method of mounting and aligning the retainer and frame, a sandwich of one or more of the retainer assemblies is selected with the two members oriented with the opposite poles attracted and sandwiched together such as illustrated in FIG. 2. In the preferred step, one of the protective backings is stripped from the adhesive backing of one only of the magnets and the sandwich is secured by engaging the adhesive to the back of the frame, preferably where the frame touches the wall, such as at the lower edge as shown in FIG. 1. When the assembly is secured in this position the frame may be hung on the wall as shown and the protective backing or sheet stripped from the other adhesive backing 34, the frame then being positioned in alignment with a preselected or preestablished marking or the like and the frame lower edge thereof pressed tightly into engagement with the wall. The adhesive 34 will then engage and secure to the wall 36.

The two magnetic members 28 and 30 will retain the frame in a temporary or semi-permanent position. The frame can then be removed from the wall simply by pulling the two magnets apart. With this arrangement the frame can then be simply hung back on the wall, aligned and then turned loose and will be pulled into the original alignment. Minor adjustments can be made by sliding the magnets relative to each other in the horizontal direction if necessary. This is one of the major advantages of the subject retainer assemblies over that of the prior art.

Figure 4:
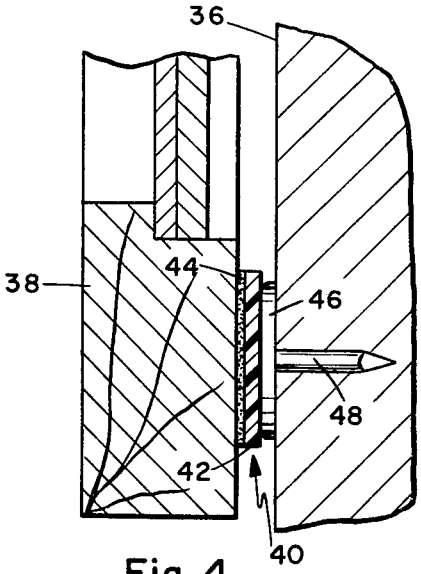
FIG. 4 is a view similar to FIG. 2 but showing an alternate magnetic connection.

An alternate embodiment of the invention is illustrated in FIG. 4. In this embodiment, a picture frame 38 is secured in place by a retainer 40. This retainer assembly comprises a magnetic strip or tape 42 secured by an adhesive backing 44 to the frame member 38. A retainer member 46 having a magnetically attractable head of a material such as iron, includes a spike 48 for extending into the wall 36. This arrangment functions substantially identical to that of the previous embodiment. The magnetically attractable iron member 46 can be secured by other means, such as an adhesive, rather than the spike 48.

Figure 5:
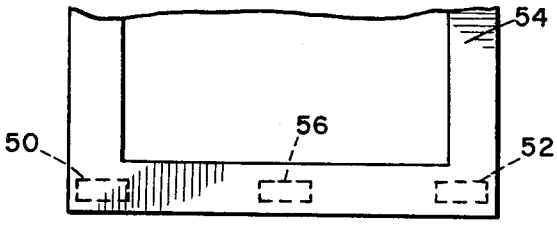
FIG. 5 illustrates an alternative retainer arrangment suitable for large pictures.

Turning now to FIG. 5, an alternate arrangment of the retainers are shown for utilization in conjunction with larger picture frames. In this arrangment, a pair of retainer assemblies 50 and 52 are secured to the lower side members of the frame 54 and a retainer assembly 56 is secured in the center of the lower member. Other arrangments are possible as necessary for retaining the member in its selected position.

The retaining assembly of the present invention may be utilized with or in conjunction with other wall hangings other than picture frames for example, mirrors and the like.

While the present invention has been described by means of a preferred embodiment it is to be understood that numerous changes and modifications may be made in the illustrated embodiment without departing from the spirit and scope of the invention as defined in the appending claims.

Having described my invention, I now claim:

1. An adjustable retaining apparatus in combination with a picture frame for adjustably securing said picture frame into vertical alignment when hanging on a wall, said combination comprising:

a picture frame for hanging on a wall, at least a pair of magnetically attracting retaining members for securing the lower edge of a picture frame into preselected aligned positions on a wall and permitting infinite lateral adjustment thereof, one of said members being a first strip of generally flat rectangular magnetic tape and including mounting means defined by an adhesive backing for mounting on said frame, the other of said members being a second generally flat rectangular strip of magnetic tape and including mounting means defined by an adhesive backing for mounting said member on said wall in opposed attracting relationship and oriented to permit infinite lateral sliding movement between said pair of retaining members while maintaining said attracting relationship.

* * * * *